United States Patent [19]

Pawluk

[11] Patent Number: 4,956,523

[45] Date of Patent: Sep. 11, 1990

[54] ARMOURED ELECTRIC CABLE WITH INTEGRAL TENSILE MEMBERS

[75] Inventor: Robert R. Pawluk, Scarborough, Canada

[73] Assignees: United Wire & Cable (Canada) Inc., Toronto, Canada; UMR-Lukton Inc., Ontario, Canada

[21] Appl. No.: 356,762

[22] Filed: May 26, 1989

[30] Foreign Application Priority Data

May 5, 1989 [CA] Canada ..... 598834

[51] Int. Cl.[5] ..... H01B 7/24

[52] U.S. Cl. ..... 174/107; 174/70 R; 174/109

[58] Field of Search ..... 174/102 R, 102 D, 107, 174/70 R, 113 R, 109

[56] References Cited

U.S. PATENT DOCUMENTS

| | | | |
|---|---|---|---|
| 3,115,542 | 12/1963 | Palandri et al. | 174/107 |
| 3,351,706 | 11/1967 | Gnerre et al. | 174/107 |
| 3,509,269 | 4/1970 | Elliott | 174/102 R |
| 3,790,697 | 2/1974 | Buckingham | 174/102 R |
| 4,360,704 | 11/1982 | Madry | 174/102 SC X |
| 4,552,432 | 11/1985 | Anderson et al. | 174/70 R X |
| 4,859,024 | 8/1989 | Rahman | 174/70 R X |

FOREIGN PATENT DOCUMENTS

| | | | |
|---|---|---|---|
| 990374 | 6/1976 | Canada | 174/109 |
| 1586661 | 3/1981 | United Kingdom | 174/107 |

OTHER PUBLICATIONS

General Electric-WCD-154, Mar. 31, 1983, p. 5.
The Okonite Company Bulletin SFC'84, p. 32.
Cablec Corporation Product Catalog, pp. 9-11.
Canada Wire CN Tower Brochure, 1973.

*Primary Examiner*—Morris H. Nimmo
*Attorney, Agent, or Firm*—Riches, McKenzie & Herbert

[57] ABSTRACT

An armoured electric cable having integral tensile members to provide additional tensile strength. The tensile members are embedded in an inner PVC jacket which securely grips the central insulated conductors over which it is extruded. The jacket is, in turn, securely gripped by an armour cover formed of a steel strip which is wound helically around the jacket and bites into longitudinal ridges on the jacket. The armour coating has an undulating shape and is covered by an outer PVC jacket which is extruded over it. Thus, in the vertical position much of the weight of the insulated conductors, inner and outer PVC jackets and armour coating can be supported by the tensile members without producing dangerous longitudinal slippage or creepage between them.

8 Claims, 1 Drawing Sheet

ARMOURED ELECTRIC CABLE WITH INTEGRAL TENSILE MEMBERS

BACKGROUND OF THE INVENTION

This invention relates generally to armoured electric cable and more particularly to a cable having increased tensile strength.

Tensile strength is a requirement for all electric cables, but is a particular concern for large power cables having long vertical runs such as in mineshafts and high rise buildings. In order to provide a sufficient safety factor, it is necessary that the tensile strength of the cable be several times the total weight of the run of cable. In the past, if the conductors themselves have not provided sufficient tensile strength it has been known for horizontal cable runs to clamp an auxiliary tensile member such as a steel wire cable to the power cable to provide additional strength. However, this arrangement shown in General Electric brochure WCD-154 dated Mar. 31, 1983, page 5 has the disadvantage of being cumbersome and costly to install. More recently, as shown in The Okonite Company Bulletin SFC'84, page 32, a cable has been provided in which the tensile member is embedded in an extruded insulating jacket in a figure-8 configuration. It is also known to embed ground wires and shielding wires in extruded jackets as shown in U.S. Pat. No. 4,360,704 to Madry which issued Nov. 23, 1982 and Cables Corporation Product Catalog, pages 9 and 11.

For vertical installations, power cables are known having a steel protective armour cover such as steel wire armour cable shown in Canada Wire CN Tower brochure dated 1973 and VERLOK (Trade Mark of the applicant) cable shown in the applicant's Canadian patent No. 990,374 which issued June 1, 1976. Of course, the steel armour coating adds to the weight of the cable and thus more tensile strength is required. As discussed in Canadian patent No. 990,374, longitudinal slippage between the extruded jacket and the armour cover was a concern. However, slippage between the tensile members and the armour cover or the central conductors is also very undesirable and dangerous.

SUMMARY OF THE INVENTION

Accordingly, it is an object of this invention to at least partially overcome the disadvantages of the prior art by providing an electric cable having tensile members integrally embedded in an inner jacket which is extruded around the conductors and to which an armoured cover is secured.

To this end, in one of its aspects, the invention provides an electric cable comprising a plurality of separate current carrying insulated conductors, an inner jacket which is pressure extruded around the insulated conductors to securely grip the insulated conductors, the inner jacket having outwardly extending projections which are deformable under pressure, at least one longitudinally extending tensile member integrally embedded in the extruded inner jacket, a protective armour metallic cover around the inner jacket which deforms at least a portion of the deformable projections of the extruded inner jacket, whereby the armour cover securely grips the extruded inner jacket and the extruded inner jacket securely grips each of the insulated conductors and the said at least one tensile member, and a protective outer jacket which is pressure extruded around the armour cover to securely grip the armour cover.

Further objects and advantages of the invention will appear from the following description taken together with the accompanying drawings.

DETAILED DESCRIPTION OF THE DRAWINGS

Figure 1:
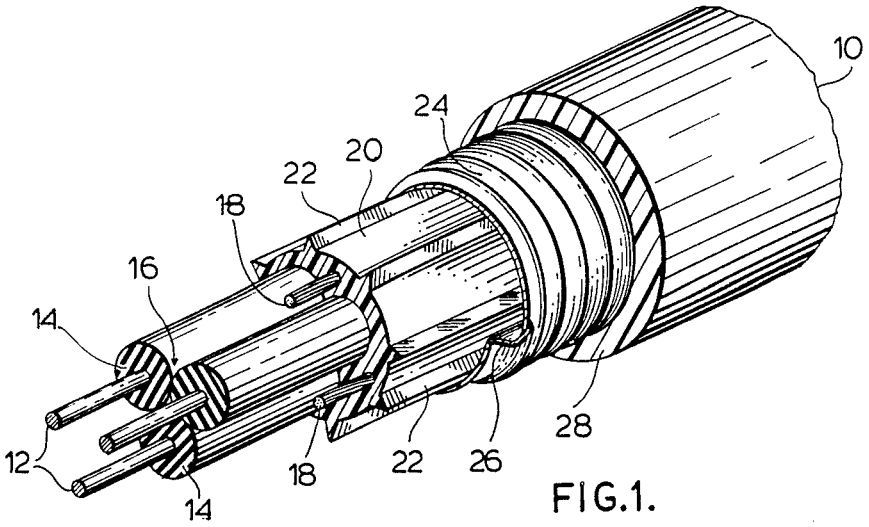
FIG. 1 is an isometric view of an electric cable according to a preferred embodiment of the invention.

Reference is first made to FIG. 1 which shows a high voltage power cable 10 having three central copper phase conductors 12. Each of the conductors 12 has an electrical insulation coating 14 formed of extruded cross linked polyethylene (XLPE). While specific materials are identified for the components of the embodiment of the invention, it is apparent that other suitable materials can be substituted for other applications. The conductors 12 may also be made of aluminum, and the insulation coating 14 may be a variety of materials or even layers of different materials. Furthermore, although three conductors 12 are shown, in other embodiment the cable may have only a single conductor or a different number of multiple conductors, depending on the application.

Figure 2:
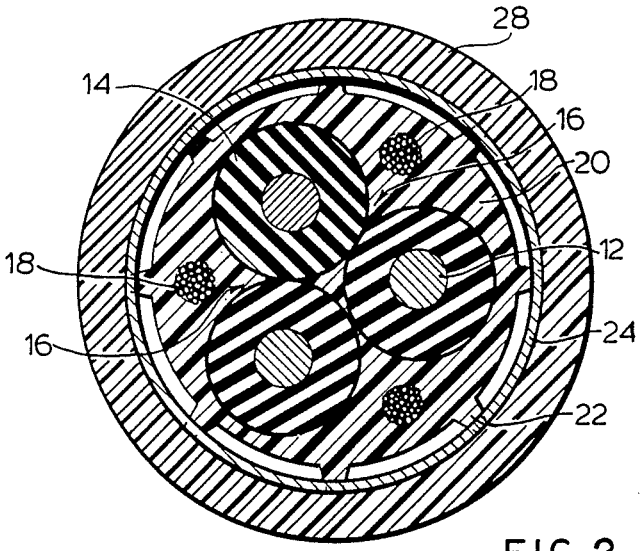
FIG. 2 is a cross-sectional view of the cable shown in FIG. 1.

As clearly seen in FIG. 2, in this embodiment the abutting coatings 14 of the three conductors 12 form three pointed interstices 16 extending inwardly between the coatings 14. Three steel tensile members 18 are located in alignment with the interstices 16 and then embedded in an inner jacket 20 of pressure extruded polyvinyl chloride (PVC). As described in the applicant's Canadian patent No. 990,374, the inner jacket 20 has a number of outwardly extending projections 22 and is formed of a deformable material such as PVC so the projections 22 will yield under pressure. In this embodiment, the projections 22 are in the form of spaced longitudinally extending ridges which facilitates extrusion. Although spaced V-shaped ridges 22 are shown, their shape or number is not critical as long as they are sufficiently deformable under pressure to provide a strong grip. In this embodiment, the tensile members 18 are formed of a number of steel wire strands which provides flexibility and ensures a strong grip by the extruded inner jacket 20 in which they are embedded. However, in other embodiments of the invention the tensile members can have a single strand and can be formed of other suitable high strength materials such as copper clad steel or KEVLAR (Trade Mark of DuPont for aramid fibers) fibers. The size and number of tensile members 18 required depends upon the weight of the cable and the application involved.

The inner jacket 20 and the tension members 18 embedded in it are then covered by a protective armour cover 24 which, in this embodiment, is formed by a steel strip 26 wound helically around the inner jacket 20. As can be seen, the steel strip has a curved cross-section shape so that overlapping turns interlock and provide the armour cover 24 with an undulating shape. The interlocking strip is wound tightly around the inner jacket 20 so that the inner part of it bites into the longitudinal extending ridges 22 by deforming them where it crosses them. This provides the armour cover 24 with a firm grip on the inner jacket 20 which, in turn, securely grips the tensile members 18. Thus, slippage of the armour cover 24 relative to the tensile members 18 which support it is minimal, and yet the cable 10 is free to bend. While the helical strip 26 is made of steel in this embodiment, it can be made of aluminum or other suitable metals for other applications. In this embodiment, the armour cover 24 is covered by a protective outer jacket 28 formed of PVC which is pressure extruded over the armour cover 24. The undulating shape of the armour cover 24 ensures that the outer jacket 28 grips it securely.

In an alternate embodiment, the armour 24 can be made of a continuous metallic sheath having a corrugated or other shape which provides suitable indentations to bite into the ridges 22 on the inner jacket 20.

In use, the cable 10 is installed in a mineshaft, for instance, by being lowered or raised vertically by a winch and then secured to the wall of the mineshaft. In the fully extended position, the total weight of the cable to be supported is very considerable. It is very dangerous if this weight causes damage to the cable as a result of slippage between the cable elements in the suspended position or creepage after it is secured in position to the wall. The cable structure according to the invention provides additional tensile strength while minimizing this danger. The tensile members 18 are securely gripped by the surrounding outer jacket 28 in which they are embedded. The inner jacket 20 securely grips the insulated conductors 12 over which it is extruded and, in turn, is securely gripped by the armour cover 24 compressing the ridges 22. Finally, the undulating armour cover 24 is securely gripped by the cuter jacket 28 which is extruded over it. Thus, much of the weight of the insulated conductors 12 and armour cover 24 can be supported by the tensile members 18 without producing longitudinally slippage or creepage between them.

While the description of the electric cable has been given with respect to one embodiment of the invention, it is not to be construed in a limiting sense. Variations and modifications will occur to those skilled in the art. For example, the elements of the cable can be made of other suitable materials than those mentioned and can have a different number of conductors 12 and/or tensile members 18. While reference has been made to power cables, the invention also applies to signal transmission or other types of cables where tensile strength is important. Reference is made to the appended claims for a definition of the invention.

What I claim is:

1. An electric cable comprising:

(a) a plurality of separate current carrying insulated conductors, (b) an inner jacket which is pressure extruded around the insulated conductors to securely grip the insulated conductors, the inner jacket having outwardly extending projections which are deformable under pressure, (c) at least one longitudinally extending tensile member integrally embedded in the extruded inner jacket, (d) a protective armour metallic cover around the inner jacket which deforms at least a portion of the deformable projections of the extruded inner jacket, whereby the armour cover securely grips the extruded inner jacket and the extruded inner jacket securely grips each of the insulated conductors and the said at least one tensile member, and (e) a protective outer jacket which is pressure extruded around the armour cover to securely grip the armour cover.

2. An electric cable as claimed in claim 1 wherein the armour cover is formed of a metallic strip which is wound helically around the inner jacket with interlocking turns which deform the projections of the inner jacket.

3. An electric cable as claimed in claim 2 wherein the armour cover has an undulating shape.

4. An electric cable as claimed in claim 2 wherein the outwardly extending projections of the extruded inner jacket are a plurality of spaced longitudinally extending ridges which are deformed by the interlocking turns of the metallic strip wound around the extruded inner jacket.

5. An electric cable as claimed in claim 4 wherein each of the current carrying conductors has a separate electrical insulation coating.

6. An electric cable as claimed in claim 5 wherein a plurality of tensile members are spaced around the conductors, the tensile members being equal in number to the conductors.

7. An electric cable as claimed in claim 6 wherein the tensile members are each formed of a plurality of wire strands.

8. An electric cable as claimed in claim 5 wherein the tensile members are each formed of high strength fibers.

* * * * *